US005606882A

United States Patent [19]

Larsen et al.

[11] Patent Number: 5,606,882

[45] Date of Patent: Mar. 4, 1997

[54] LOCK ASSEMBLY WITH INTERCHANGEABLE KEY PLUG

[75] Inventors: Marvin L. Larsen; Kenneth L. McConnell, both of New Hampton, Iowa

[73] Assignee: Tri/Mark Corporation, New Hampton, Iowa

[21] Appl. No.: 309,801

[22] Filed: Sep. 21, 1994

[51] Int. Cl.[6] ..... F05B 27/00; F05B 29/00

[52] U.S. Cl. ..... 70/369; 70/371; 70/421; 70/337; 70/379 A

[58] Field of Search ..... 70/369, 371, 370, 70/379 R, 379 A, 421, 208, 337, 340

[56] References Cited

U.S. PATENT DOCUMENTS

| | | | |
|---|---|---|---|
| 1,216,859 | 2/1917 | Shaw | 70/379 A |
| 1,785,634 | 12/1930 | Lawrence | 70/340 |
| 1,788,834 | 1/1931 | Hurd | 70/340 |
| 1,805,891 | 5/1931 | Shinn | 70/369 |
| 1,832,108 | 11/1931 | Falk | 70/369 |
| 1,922,889 | 10/1933 | Falk . | |
| 2,036,764 | 4/1936 | Lowe | 70/369 |
| 2,061,456 | 11/1936 | Falk | 70/369 |
| 2,347,802 | 5/1944 | Voight | 70/369 |
| 2,460,709 | 2/1949 | Navarro | 70/369 |
| 3,260,080 | 7/1966 | Wellekens . | |
| 3,283,549 | 11/1966 | Mees | 70/208 |
| 3,863,476 | 2/1975 | Patriquin . | |
| 4,099,397 | 7/1978 | Dauenbaugh | 70/371 |
| 4,398,405 | 8/1983 | Patriquin . | |
| 4,404,825 | 9/1983 | Dixon et al. . | |
| 4,420,954 | 12/1983 | Hieronymi et al. | 70/208 |
| 4,510,779 | 4/1985 | Ahad | 70/208 |
| 4,630,457 | 12/1986 | Kincaid et al. | 70/369 |
| 4,638,649 | 1/1987 | Chao | 70/208 |
| 4,672,827 | 6/1987 | Craig | 70/369 |
| 4,715,201 | 12/1987 | Craig | 70/369 |
| 4,761,978 | 8/1988 | Walla . | |
| 4,914,932 | 4/1990 | Walla . | |
| 5,101,649 | 4/1992 | Duval | 70/369 |
| 5,109,685 | 5/1992 | Westwinkel | 70/369 |
| 5,119,654 | 6/1992 | Ceron et al. | 70/369 |
| 5,235,832 | 8/1993 | Lux et al. . | |
| 5,421,179 | 6/1995 | Bergström | 70/369 |
| 5,431,034 | 7/1995 | Fann et al. | 70/369 |

*Primary Examiner*—Darnell M. Boucher
*Attorney, Agent, or Firm*—Wood, Phillips, VanSanten, Clark & Mortimer

[57] ABSTRACT

A lock assembly having a key plug with an axis, a first housing defining a receptacle for the key plug and guiding movement of the key plug in the receptacle around the key plug axis, a latch assembly including a first movable latch element, structure cooperating between the first housing and the latch assembly for supporting the latch assembly in an operative position on the first housing wherein the first latch element is movable between first and second positions relative to the first housing, a retaining element, structure for mounting the retaining element to the key plug for movement relative to the key plug between first and second positions, with the key plug being movable into the key plug receptacle to an operative position and removable from the key plug receptacle with the retaining element in its first position, and structure cooperating between the retaining element and latch assembly for preventing withdrawal of the key plug from the first housing receptacle with the key plug in its operative position and the retaining element in its second position.

27 Claims, 8 Drawing Sheets

LOCK ASSEMBLY WITH INTERCHANGEABLE KEY PLUG

BACKGROUND OF THE INVENTION

1. Field of the Invention

This invention relates to lock assemblies of the type having a housing with a key-operated plug that is rotatable within the housing about an axis to effect movement of a latch element and, more particularly, to a lock assembly wherein the key plug can be removed to facilitate interchange of key plugs and/or repair of a key plug.

2. Background Art

It is well known to construct lock assemblies that are actuated through a key operated plug. The plug is rotatable guidingly within a housing to effect movement of a latch element. This type of actuating mechanism is used on conventional door knobs, latches, and deadbolts. It is also used on paddle latches on closures for motor homes and tool boxes. A similar actuating mechanism is also used on furniture locking systems.

Typically, the plug has a plurality of wafers that are movable transversely to the plug axis between extended and retracted positions by insertion of a key into an axial keyway in the plug. In an extended position, the wafers project into undercut guide slots in the housing in which the plug is journalled for rotation. With the wafers extended, the plug is fixed against rotation relative to the housing. By extending a key into the keyway through the plug, the wafers can be retracted to allow rotation of the plug mound the plug axis to effect movement of a latch element operatively connected to the key plug.

One desirable feature of this type of lock assembly is the ability to remove and replace the key plug. This allows the lock assembly to be "re-keyed" in the event that the system security has been compromised. This also permits universal construction for the housing and selective "keying alike" or diverse keying as may be the desire of the end user.

It is a goal of designers of lock assemblies with removable key plugs to provide a structure that has high integrity, i.e. is highly secure, yet one which can be manufactured efficiently and at an affordable price.

Examples of known lock assemblies with removable key plugs are disclosed in each of the following patents - U.S. Pat. No. 1,922,889, to Falk; U.S. Pat. No. 3,260,080, to Wellekens; U.S. Pat. No. 3,863,476, to Patriquin; U.S. Pat. No. 4,398,405, to Patriquin; U.S. Pat. No. 4,404,825, to Dixon et al; and U.S. Pat. No. 5,235,832, to Lux et al.

One desirable feature in Falk is that the plug part 11 can be pre-assembled to the outer housing. The plug pall 11 remains at all times operatively associated with the housing 10. If it is desired to change the keying for the system, only the plug part 12 need be removed from the housing 10 and separated from the part 11. This reduces the cost and complexity of the replaced part and does not require resetting or adjustment of the plug part 11 once the plug part 12 is moved.

Falk maintains the plug part 12 operatively on the housing 10 through a radially projecting disk/wafer 28 which moves into a radial groove 31 in the housing. Formation of the internal groove 3 1 adds considerably to the expense and complication of manufacture of the housing 10.

A further problem with some prior an locks, using a wafer and guide slot combination to prevent axial withdrawal of the associated plug, is that this type of system can be relatively easily "picked". Unauthorized entry may be accomplished by prying the locking wafer to a retracted position, as with a sharp instrument, such as a paper clip, or the like. Once the locking wafer is retracted, the key plug can be withdrawn axially from the housing to gain unauthorized access through the previously locked closure/drawer.

While the above type of system may facilitate interchange of key plugs, such systems may at the same time facilitate a security breach.

SUMMARY OF THE INVENTION

The present invention is specifically directed to overcoming the above enumerated problems in a novel and simple manner.

In one form of the invention, a lock assembly is provided having a key plug with an axis, a first housing defining a receptacle for the key plug and guiding movement of the key plug in the receptacle around the key plug axis, a latch assembly including a first movable latch element, structure cooperating between the first housing and the latch assembly for supporting the latch assembly in an operative position on the first housing wherein the first latch element is movable between first and second positions relative to the first housing, a retaining element, structure for mounting the retaining element to the key plug for movement relative to the key plug between first and second positions, with the key plug being movable into the key plug receptacle to an operative position and removable from the key plug receptacle with the retaining element in its first position, and structure cooperating between the retaining element and latch assembly for preventing withdrawal of the key plug from the first housing receptacle with the key plug in its operative position and the retaining element in its second position.

In one form, the retaining element is a first wafer and the structure mounting the retaining element to the key plug mounts the first wafer for movement relative to the key plug transversely to the key plug axis between its first and second positions.

The invention also contemplates the combination of the above structure with a first support on which the lock assembly is mounted and a second support on which the first support is mounted for movement relative to the second support, wherein the latch element includes structure cooperating between the first and second supports for limiting movement of the first support relative to the second support.

The second support may be a second housing. The first support may be a paddle mounted to the second housing for movement between a normal position and a release position, with the first housing being on the paddle. A latch mechanism can be provided on the second housing and has a second latch element that is movable relative to the second housing between latched and unlatched positions. Structure is provided cooperating between the paddle and the latch mechanism for moving the second latch element between the latched and unlatched positions as an incident of the paddle moving between the normal and release positions.

Structure may be provided cooperating between the first latch element and second housing for a) preventing movement of the paddle from its normal position to its release position with the first latch element in one of its first and second positions and b) permitting the paddle to move from its normal position to its release position with the first latch element in the other of its first and second positions.

The above lock assembly may be provided in combination with a frame defining an opening, wherein the first support is a closure that is movable relative to the frame between a) an open state wherein the frame opening can be accessed, and b) a closed state. A latch mechanism can be provided on the closure and has a second latch element movable relative to the closure between c) a latched position wherein the second latch element maintains the closure in the closed state and d) an unlatched position. Structure may be provided cooperating between the second latch element and frame for maintaining the closure in a closed state relative to the frame.

In another form, there is a latch mechanism on the first housing with a second latch element movable between a latched position and an unlatched position. An actuator is provided for the latch mechanism. Structure is provided for mounting the actuator for movement relative to the first housing between a normal position and a release position. The first latch element is movable between first and second positions, with there being structure cooperating between the actuator and latch mechanism for moving the second latch element from its latched position to its unlatched position as an incident of the actuator moving from its normal position to its release position. There further may be means cooperating between the first latch element and actuator for a) preventing the actuator from moving from its normal position into its release position with the first latch element in one of its first and second positions and b) allowing the actuator to move from its normal position into its release position with the first latch element in the other of the first and second positions.

The actuator may be a pivotable paddle or have another configuration.

In one form, the first housing has a wall and the latch assembly includes a body and a holding element, with the body and holding element captively embracing the first housing wall.

In one form, the latch assembly includes a body having a curved wall extending through less than 360°, and the structure cooperating between the retaining element and latch assembly includes an opening in the curved wall on the body into which the retaining element projects with the retaining element in its second position.

In one preferred form, the curved wall on the body extends through approximately 180° to facilitate, among other things, the formation of the opening therein.

The invention further contemplates the above structure in combination with a removal key. In this form, the key plug has an axially extending keyway, with there being structure cooperating between the removal key and first wafer for moving the first wafer from its second position into its first position as an incident of the removal key being directed into the keyway in the key plug.

The structure may be provided cooperating between the key plug and first housing for a) permitting movement of the key plug about the key plug axis with the first cooperating structure in a first state and b) preventing movement of the key plug about the key plug axis with the first cooperating structure in a second state. A change key can also be provided, with there being structure cooperating between the change key and first cooperating structure for changing the first cooperating structure from its second state into its first state as an incident of the change key being directed into the keyway in the key plug. The first wafer remains in the second position with the change key in the keyway in the key plug.

The first cooperating structure can include at least a second wafer mounted to the key plug for movement relative to the key plug transversely to the key plug axis.

Structure may be provided cooperating between the removal key and the first cooperating structure for changing the first cooperating structure from its second state into its first state as an incident of the removal key being directed into the keyway in the key plug.

There further may be structure cooperating between the key plug housing and the first wafer for preventing withdrawal of the key plug from the key plug receptacle with the first wafer in its second position without rotating the key plug relative to the key plug housing about the axis of the key plug.

The structure cooperating between the key plug and the first wafer for preventing withdrawal of the key plug may include an axially facing shoulder on the key plug housing.

When the structure cooperating between the retaining element and latch assembly is in the form of the first wafer, which is projectable into the curved wall opening, the first wafer axially overlaps the axially facing shoulder on the key plug housing with the first wafer in its first position. The first wafer does not extend into the curved wall on the body with the first wafer in its first position.

The first cooperating structure may include an axial guide slot that receives the at least second wafer with the first cooperating structure in its second state.

In another form of the invention, a lock assembly is provided having a key plug with an axis, a first housing defining a receptacle for the key plug and for guiding movement of the key plug in the receptacle about the key plug axis, a latch assembly including a first movable latch element, structure cooperating between the latch assembly and at least one of the key plug and the first housing for supporting the latch assembly in operative position wherein the first latch element is movable between first and second positions relative to the first housing, a retaining element, structure mounting the retaining element to the key plug for movement relative to the key plug between first and second positions, with the key plug being selectively movable into the key plug receptacle to an operative position and removable from the key plug receptacle with the retaining element in its first position, and second structure cooperating between the retaining element and the first housing for preventing the key plug from being moved axially out of its operative position and fully separated from the first housing without rotation of the key plug relative to the housing with the retaining element in its first position.

This arrangement makes the lock assembly more tamperproof by prohibiting withdrawal of the key plug by merely resituating the retaining element. This arrangement may require the use of a key to effect turning of the key plug as would allow separation from the associated first housing.

The second structure may include an axially facing shoulder extending less than 360° around the axis of the first housing.

The above structure may be provided in combination with a removal key that may be directed into an axially extending keyway in the key plug. Structure may be provided cooperating between the removal key and the retaining element for moving the retaining element from its second position into its first position as an incident of the removal key being directed into the keyway in the key plug. There further may be structure cooperating between the removal key and first cooperating structure for changing the first cooperating structure from its second state into its first state as an incident of the removal key being directed into the keyway plug.

A change key may also be provided, with there being structure cooperating between the change key and the first cooperating structure for changing the first cooperating structure from its second state into its first state as an incident of the change key being directed into the keyway in the key plug. The retaining element remains in the second position with the change key in the keyway in the key plug.

DETAILED DESCRIPTION OF THE DRAWINGS

Figure 1:
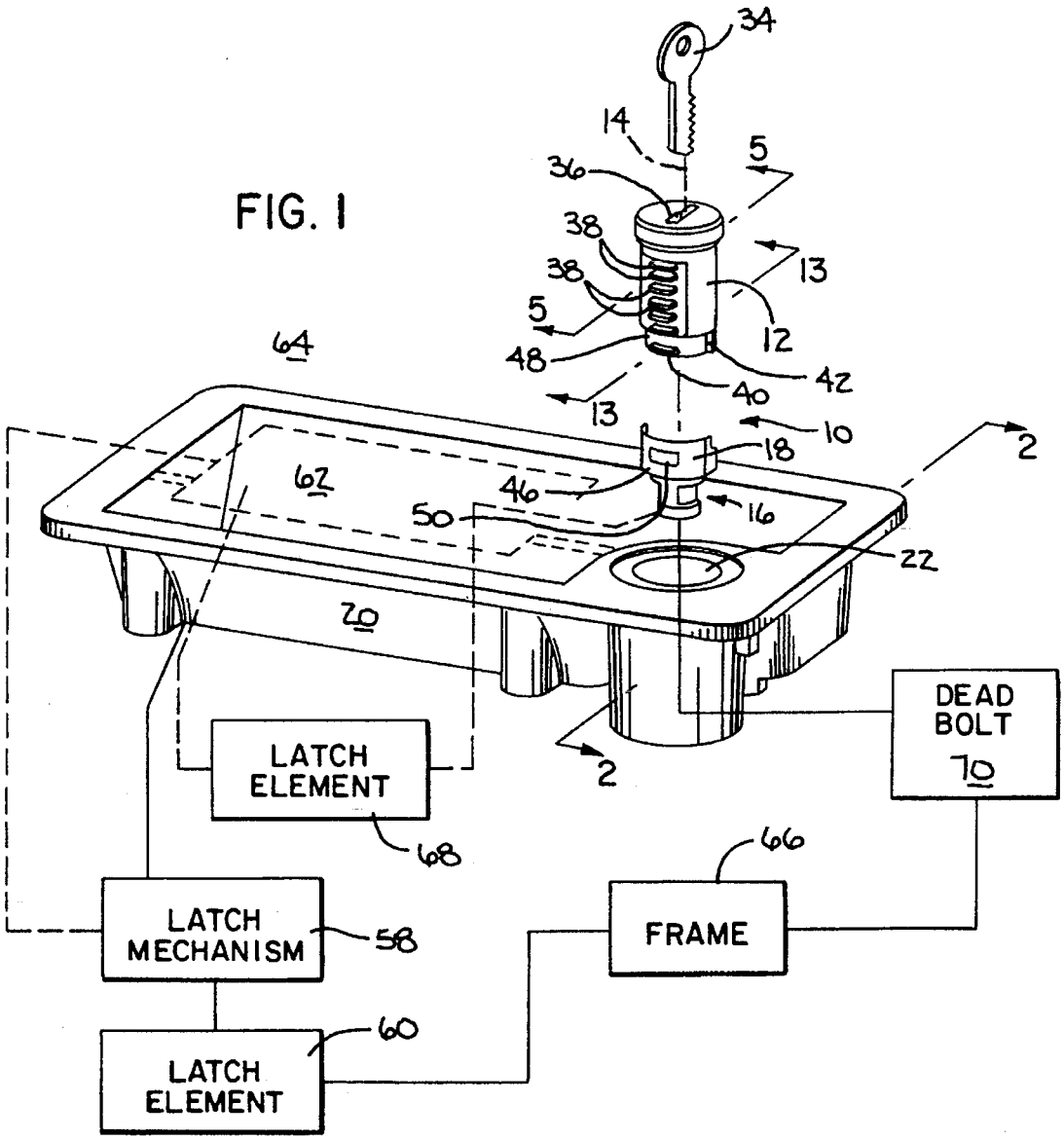
FIG. 1 is an exploded perspective view of a lock assembly, according to the present invention, mounted on a housing having a latch mechanism with a paddletype actuator.
Figure 2:
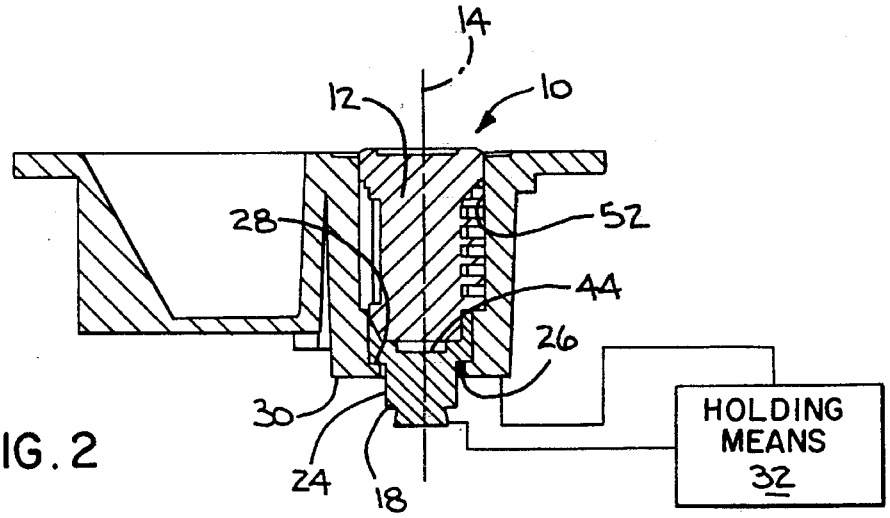
FIG. 2 is a cross-sectional view of the inventive lock assembly in an operative position on the housing and taken along line 2—2 of FIG. 1.

In FIGS. 1 and 2, one form of lock assembly, according to the present invention, is shown at 10. The lock assembly 10 includes a cylindrical key plug 12 with a central axis 14. The key plug 12 is engageable with a latch assembly 16 to effect rotation of at least part of the latch assembly 16 about the axis 14. In this version, the latch assembly 16 consists of a body 18 which defines a latch element that is releasably joinable with the key plug 12 to be rotatable therewith about the axis 14.

The lock assembly 10, consisting of the key plug 12 and latch assembly 16, can be used as an actuating mechanism on a wide range of hardware and in a wide range of environments. The structures shown herein with the lock assembly 10 are only exemplary.

In FIGS. 1 and 2, the lock assembly 10 is shown attached to a cup-shaped housing/support 20. The housing/support 20 defines a cylindrical receptacle 22 for the key plug 12. The key plug 12 is guided by the housing/support 20 in rotation about the axis 14.

The lock assembly 10 can be assembled as a unit or, alternatively, the body/latch element 18 can be pre-assembled to the housing/support 20, as described below. In this particular version, the body/latch element 18 has a stepped, outer surface 24 defining an axially facing, annular shoulder 26 which is abuttable to an oppositely facing shoulder 28 defined by a wall 30 on the housing/support 20 at the base of the receptacle 22. Suitable holding means at 32, of a type known to those skilled in the art, can be used to captively embrace the wall 30 in conjunction with the shoulder 26 and thereby prevent axial movement of the body/latch element 18 relative to the housing/support 20, while permitting rotation of the body/latch element 18 around the axis 14.

After the body/latch element 18 is assembled to the housing/support 20, the plug 12 can be operatively connected to the body/latch element 18. This connection is accomplished by first directing a removal key 34 through an axial keyway 36 in the plug 12. This retracts five conventional wafers 38 and a retaining wafer 40 at the distal end 42 of the plug 12. The key plug 12 can then be slid axially into the receptacle 22 until the distal end 42 of the key plug 12 nests in a receptacle 44 defined by the body/latch element 18.

The body/latch element 18 has a curved wall 46 that extends through approximately 180°. With the key plug 12 nested in the receptacle 44, this curved wall 46 wraps around a radial undercut 48 at the distal end 42 of the key plug 12.

By withdrawing the removal key 34, the wafers 38, 40 are allowed to extend transversely to the axis 14. The wafer 40 projects into an opening 50 in the curved wall 46 on the body/latch element 18 so as to thereby prevent relative rotational and axial movement between the key plug 12 and body/latch element 18.

Extension of the wafers 38 causes the wafers 38 to move into a radially undercut, axially extending, guide slot 52 in the housing/support 20. The wafers 38 and guide slot 52 are relatively configured so that with the wafers 38 extended into the guide slot 52, they cooperatively define a means to prevent rotation of the key plug 12 relative to the housing/support 20 around the axis 14.

By inserting a change key 54, as shown in FIGS. 5–8, the wafers 38 can be retracted without retracting the retaining wafer 40. This allows the key plug 12 to be rotated within the housing/support 20 to operate the lock assembly 10 without permitting the key plug 12 to disengage from the body/latch element 18.

The body/latch element 18 can be used in a variety of different manners on the housing/support 20 shown in FIGS. 1 and 2. In one form, the housing/support 20 has a conventional latch mechanism 58 mounted thereto that operates a latch element 60, through an actuator/paddle handle 62. The latch element 60 is movable between a latched position and an unlatched position.

In one form, the housing/support 20 and lock assembly 10 are mounted on a closure 64 that is movable relative to a frame 66 defining an access opening. The closure 64 is movable between an open state, wherein the entry opening can be accessed, and a closed state. By moving the paddle handle 62 from its normal position, shown in phantom lines in FIG. 1, to a release position, the latch element 60 is moved from its latched position to its unlatched position to allow the closure 64 to be opened.

The lock assembly 10 can also be used to reposition a latch element 68 which cooperates between the body/latch element 18 and the paddle 62. In one position, the latch element 68 locks the paddle 62 against movement relative to the housing/support 20. In a second position, which is achieved by rotation of the body/latch element 18, the paddle 62 is free to move relative to the housing/support 20 to operate the latch element 60.

The lock assembly 10 can also be used to separately operate a deadbolt latch element 70, which is projectable into a catch (not shown) on the frame 66 to maintain the closure 64 in a closed state relative to the frame 66.

Figure 3:
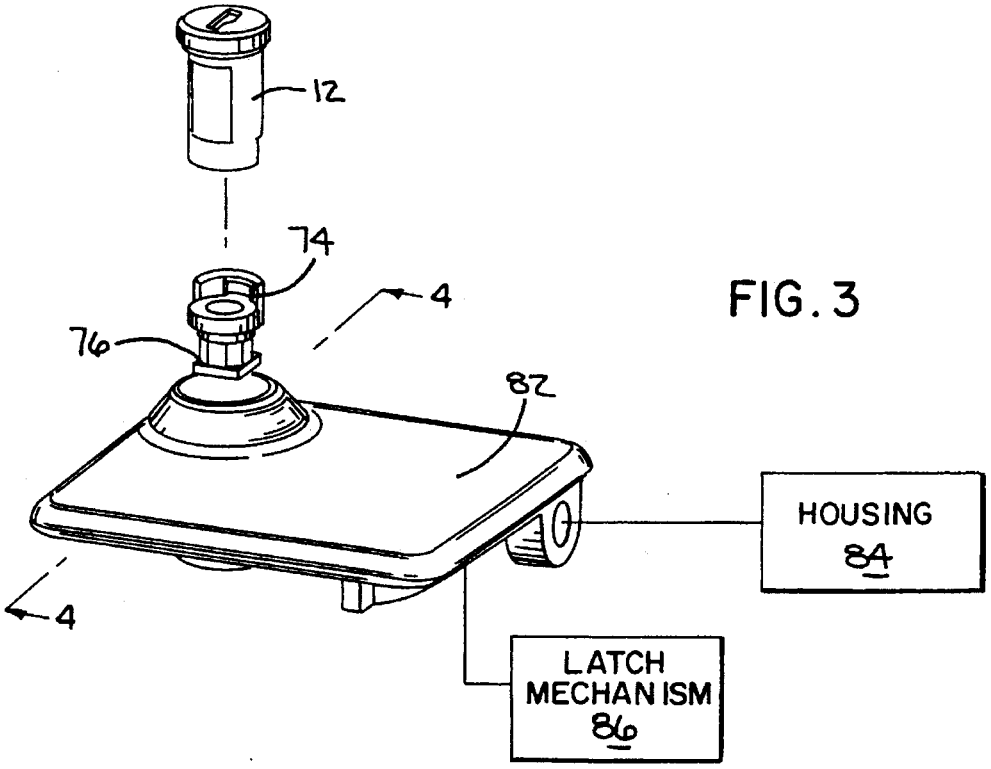
FIG. 3 is an exploded perspective view of a modified form of lock assembly, according to the present invention, mounted directly on an actuating paddle.
Figure 4:
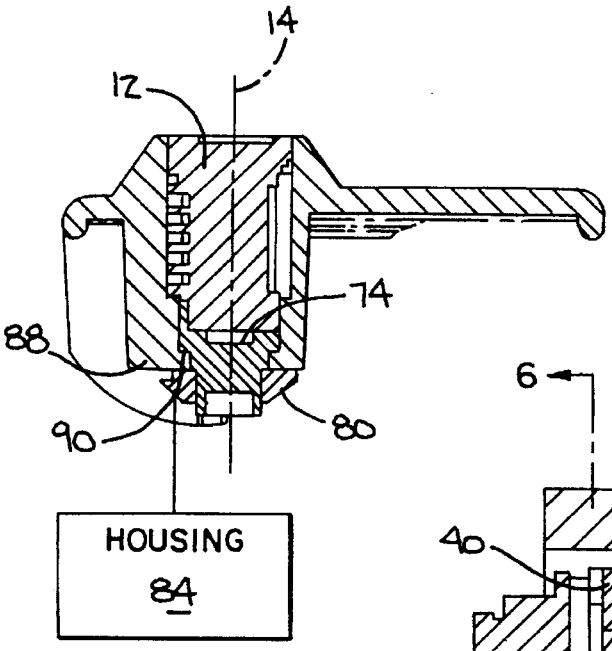
FIG. 4 is a cross-sectional view of the inventive lock assembly in FIG. 3 in an operative position on the paddle and taken along line 4—4 of FIG. 3.
Figure 5:
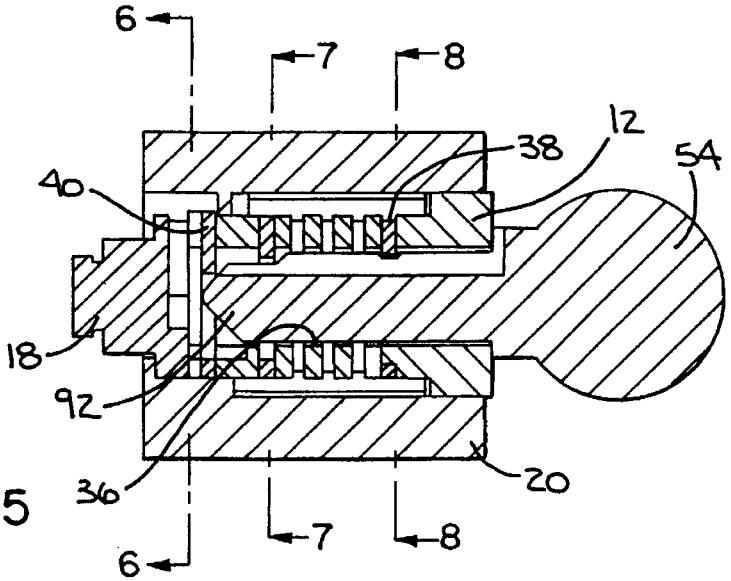
FIG. 5 is a cross-sectional view of the inventive lock assembly in its operative position, with a change key inserted in a key plug thereon and taken along line 5—5 of FIG. 1.
Figure 6:
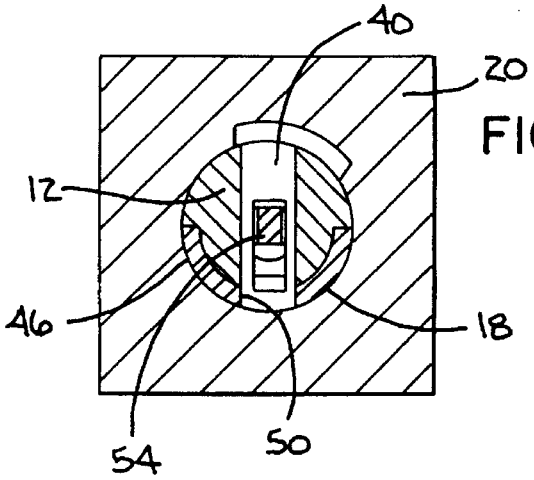
FIG. 6 is a cross-sectional view of the inventive lock assembly taken along line 6—6 of FIG. 5.
Figure 7:
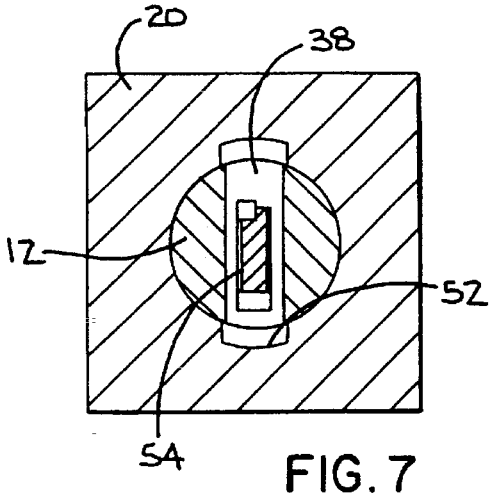
FIG. 7 is a cross-sectional view of the inventive lock assembly taken along line 7—7 of FIG. 5.
Figure 8:
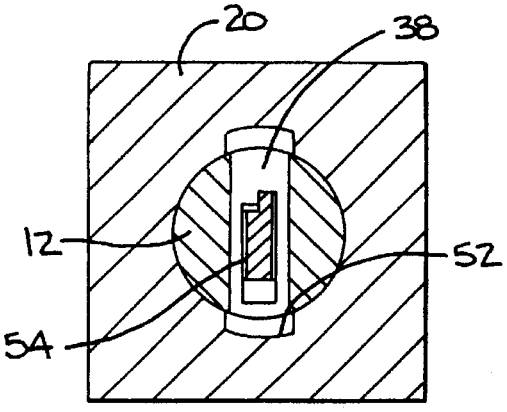
FIG. 8 is a cross-sectional view of the inventive lock assembly taken along line 8—8 of FIG. 5.
Figure 9:
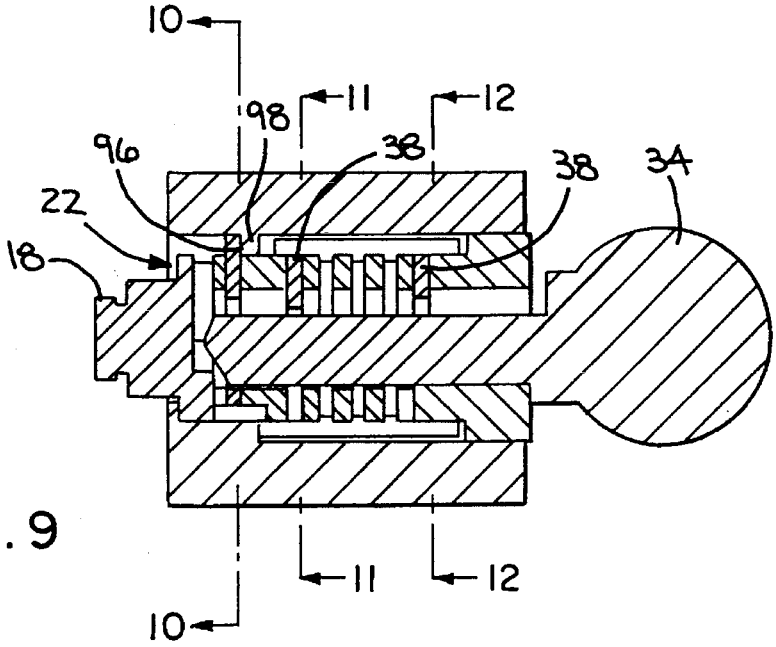
FIG. 9 is a cross-sectional view as in FIG. 5 with a removal key inserted into the key plug on the inventive lock assembly.
Figure 10:
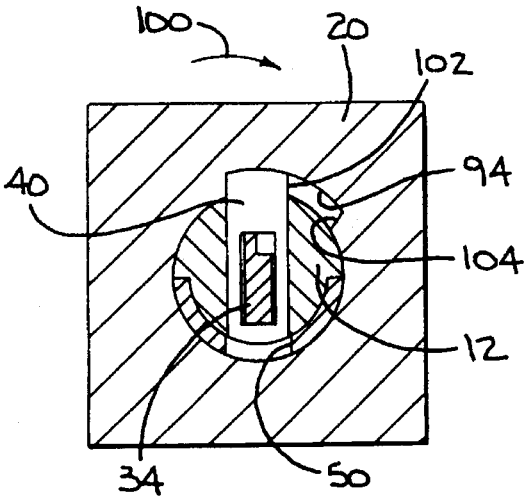
FIG. 10 is a cross-sectional view of the inventive lock assembly taken along line 10—10 of FIG. 9.
Figure 11:
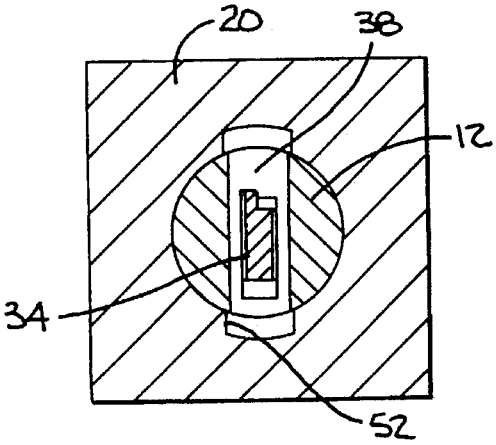
FIG. 11 is a cross-sectional view of the inventive lock assembly taken along line 11—11 of FIG. 9.
Figure 12:
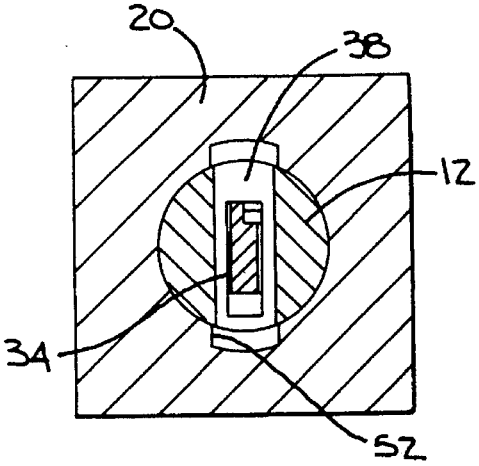
FIG. 12 is a cross-sectional view of the inventive lock assembly taken along line 12—12 of FIG. 9.
Figure 13:
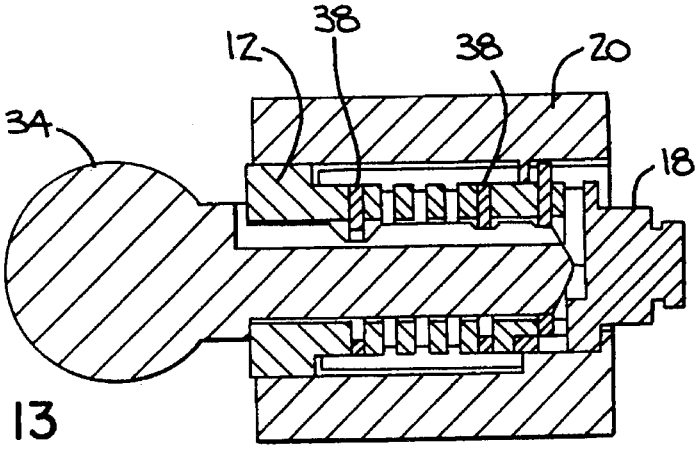
FIG. 13 is a cross-sectional view of the inventive lock assembly taken along line 13—13 of FIG. 1 with the key plug in the same position as shown in FIGS. 9–12.
Figure 14:
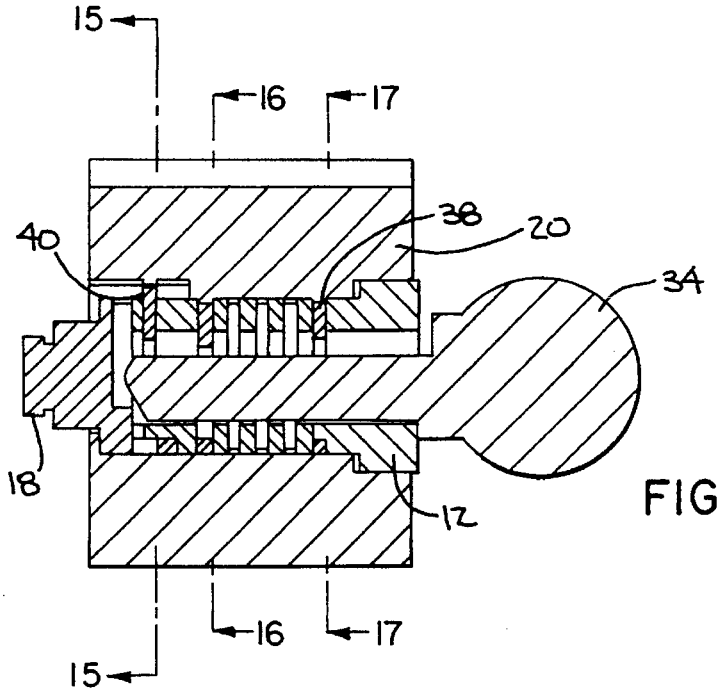
FIG. 14 is a view of the inventive lock assembly as in FIG. 9 with the key plug rotated to initiate removal thereof.
Figure 15:
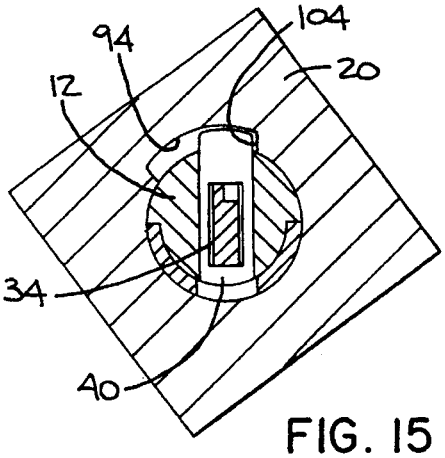
FIG. 15 is a cross sectional view of the inventive lock assembly taken along line 15—15 of FIG. 14.
Figure 16:
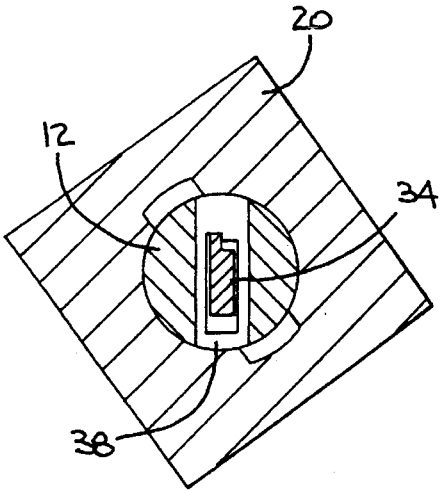
FIG. 16 is a cross-sectional view of the inventive lock assembly taken along line 16—16 of FIG. 14.
Figure 17:
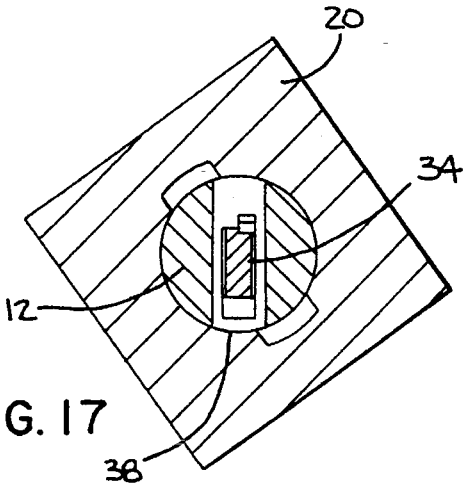
FIG. 17 is a cross-sectional view of the inventive lock assembly taken along line 17—17 of FIG. 14.
Figure 18:
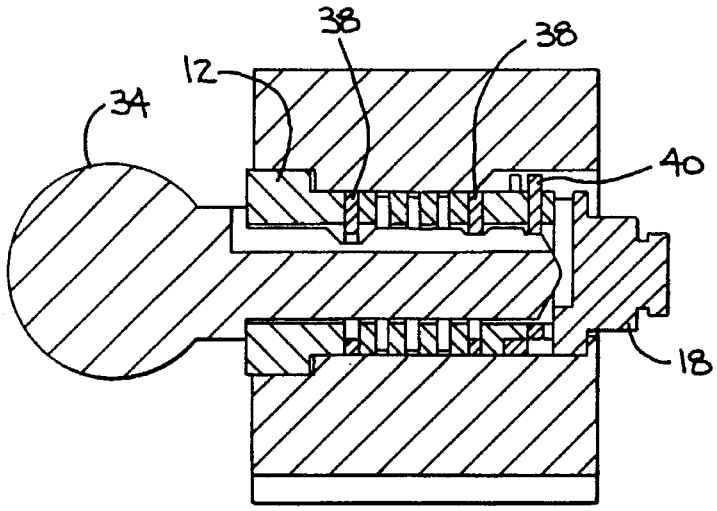
FIG. 18 is a view as in FIG. 13 with the key plug oriented as shown in FIGS. 14—17.
Figure 19:
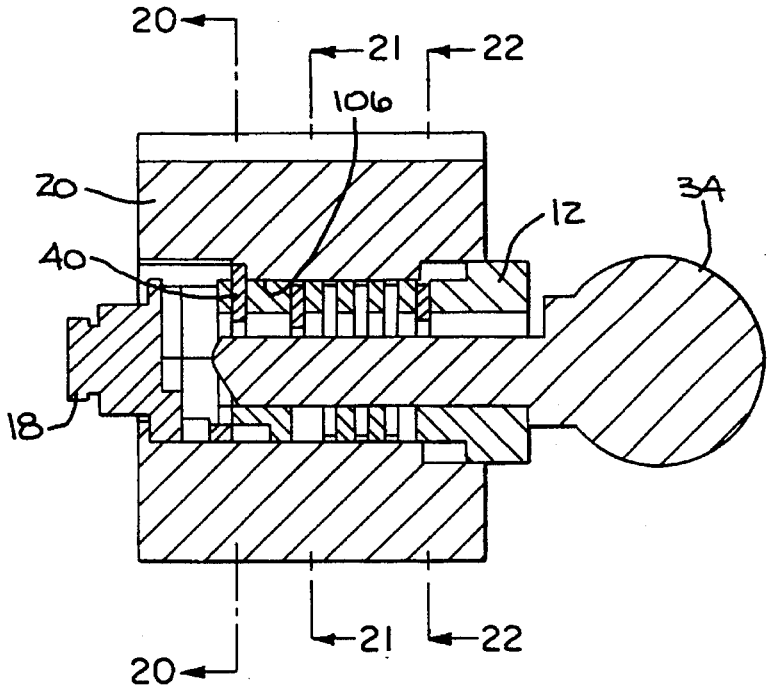
FIG. 19 is a view of the inventive lock assembly as in FIG. 14 and with the key plug partially retracted.
Figure 20:
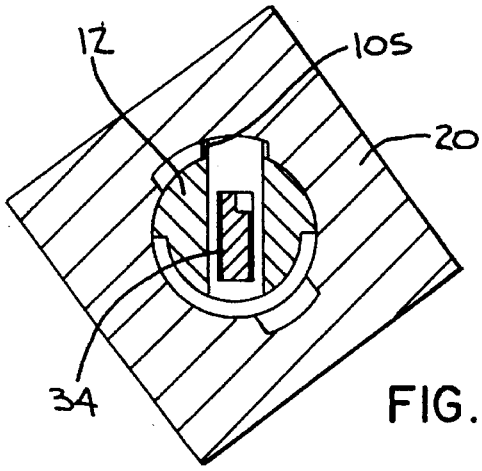
FIG. 20 a cross-sectional view of the inventive lock assembly taken along line 20—20 of FIG. 19.
Figure 21:
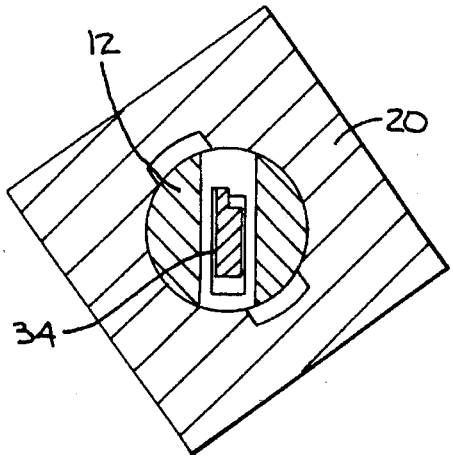
FIG. 21 is a cross-sectional view of the inventive lock assembly taken along line 21—21 of FIG. 19.
Figure 22:
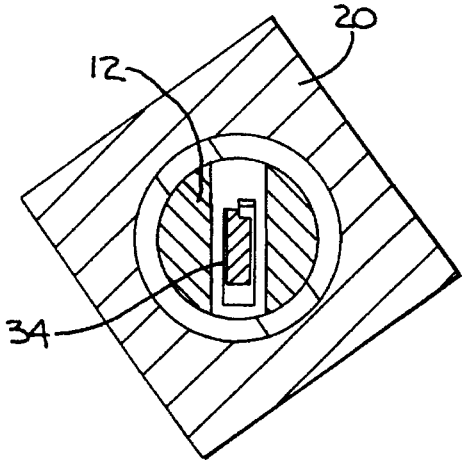
FIG. 22 is a cross-sectional view of the inventive lock assembly taken along line 22—22 of FIG. 19.
Figure 23:
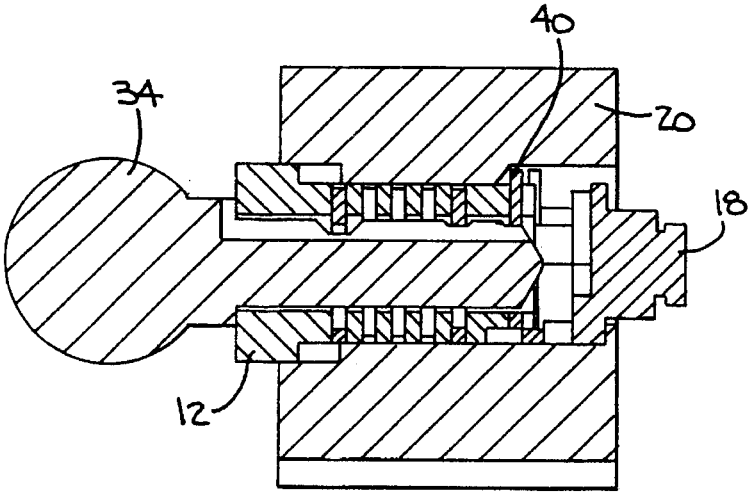
FIG. 23 is a view as in FIG. 18 with the key plug retracted as in FIGS. 19–22.
Figure 24:
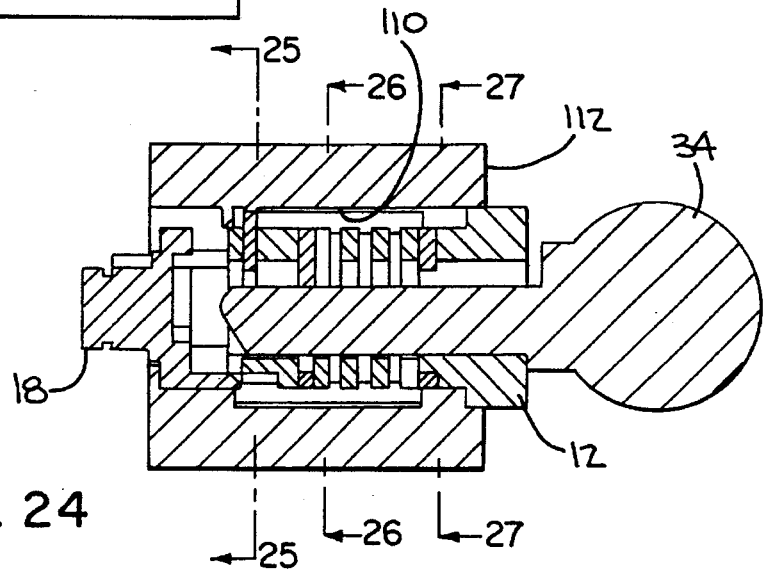
FIG. 24 is a view of the inventive lock assembly as shown in FIG. 18 and with the key plug rotated back to the position shown in FIGS. 5–13, to facilitate removal thereof.
Figure 25:
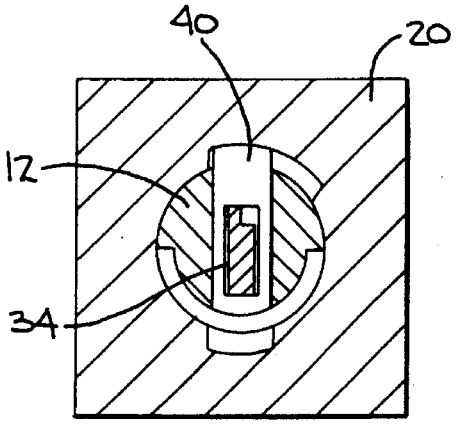
FIG. 25 is a cross-sectional view of the inventive lock assembly taken along line 25—25 of FIG. 24.
Figure 26:
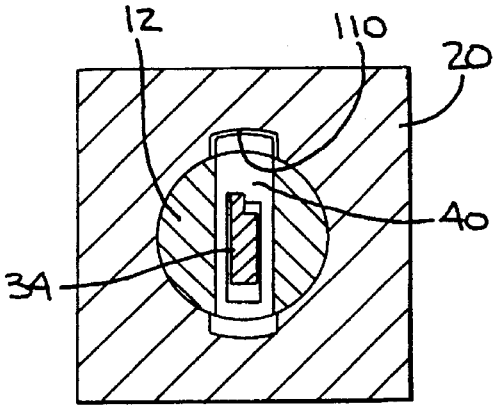
FIG. 26 is a cross-sectional view of the inventive lock assembly taken along line 26—26 of FIG. 24.
Figure 27:
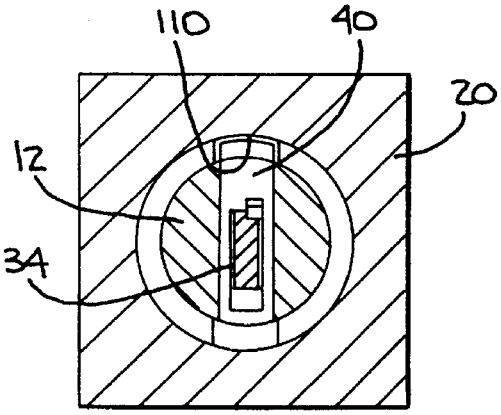
FIG. 27 is a cross-sectional view of the inventive lock assembly taken along line 27—27 of FIG. 24.
Figure 28:
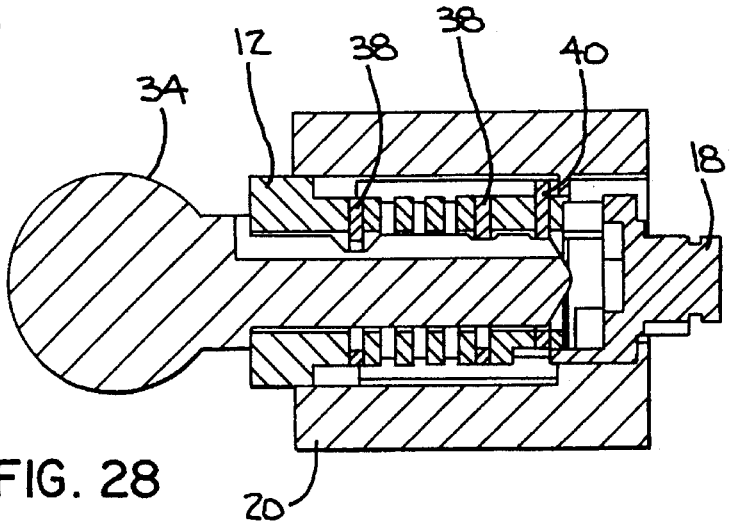
FIG. 28 is a cross-sectional view as in FIG. 23 with the key plug in the position shown in FIGS. 24–27.

A modified form of body/latch element is shown at 74 in FIGS. 3 and 4. The primary difference between the body/latch element 74 and the body/latch element 18 resides at the distal end 76 of the body/latch element 74, which is configured to make keyed connection with a separate latch element 80, which moves in rotation with the key plug 12 about the axis 14.

The plug 12 and body/latch element 74 are shown mounted directly to an actuating paddle support 82, that may be pivotably connected to a housing 84 similar to the housing/support 20 shown in FIG. 1. Pivoting of the paddle 82 relative to the housing 84 effects operation of a latch mechanism 86.

The latch element 80 is constructed to cooperate with the housing 84 so that in a first position it blocks pivoting of the paddle 82 from a normal position to a release position and in a second position the paddle 82 is free to pivot to operate the latch mechanism 86.

The body/latch element 74 is maintained in its operative position by captively embracing a wall 88 on the paddle 82 between an annular, axially facing shoulder 90 on the body/latch element 74 and the latch element 80.

With the above arrangement, construction of each body/latch element 18, 74 is facilitated. Positive connection results between the plug 12 and body/latch elements 18, 74 without requiring any internal groove within the housing/support 20 for direct connection between the key plug 12 and housing/support 20. The body/latch elements 18, 74 can be conveniently pre-assembled, whereafter the key plug 12 can be easily placed into its operative position through the use of the removal key 34. Thereafter, the change key 54 can be used exclusively to operate the lock assembly 10.

Further, a single key plug construction can be utilized for each of the applications, described with respect to FIGS. 1 and 3, as well as other applications contemplated by the invention. This provides a potential convenience to the manufacturer, the supplier, and the end user.

While the invention contemplates that the guide slot 52 for the wafers 38, 40 could be made in a straight line on the support/housing 20, this arrangement may pose a security risk. This problem arises particularly with lock assemblies having a single key removal position. With this arrangement, one can "pick" the lock assembly 10 by prying the retaining wafer 40 to a retracted position and thereafter slide the key plug 12 axially out of the receptacle 22. On those lock assemblies with multiple key removal positions, the key plug and receptive housing can be modified, differently than explained hereinbelow, to prohibit withdrawal of the key plug through axial movement thereof with the lock assembly in its "locked" state.

To prevent unauthorized entry, the lock assembly 10 and cooperating housing/support 20 are constructed according to the invention to require that the key plug 12 be rotated about its axis 14 to effect removal thereof, even with the retaining wafer 40 retracted Thus, even if the retaining wafer 40 is retracted, the key plug 12 can be removed only with an appropriate key inserted so as to retracted the wafers 38 and allow rotation of the key plug 12 about the axis 14. This structure is shown in detail in FIGS. 5–28.

In FIGS. 5–8, the key plug 12 is shown in its normal operating position on the housing/support 20. With the change key 54 directed into the keyway 36, the wafers 38 (only two of five shown in FIGS. 5–28) retract from the guide slot 52 to allow the key plug 12 to rotate the body/latch element 18. The distal end 92 of the change key 54 is not long enough to reposition the retaining wafer 40. Consequently, the retaining wafer 40 remains extended into the opening 50 in the curved wall 46 on the body/latch element 18.

By withdrawing the change key 54 and directing the removal key 34 into the keyway 36, as shown in FIGS. 9–13, the retaining wafer 40 is cammed out of the opening 50 and into an undercut slot portion 94. The removal key 34 is constructed to also retract the wafers 38 from the guide slot 52 in the same manner as the change key 54.

With the retaining wafer 40 repositioned by the removal key 34, the retaining wafer 40 abuts to an axial facing surface/shoulder 96 on a wall 98 which projects radially into the receptacle 22. This prohibits further axial withdrawal of the key plug 12 from the housing 20.

The guide slot portion 94 has a circumferential extent that is greater than that of the retaining wafer 40. This permits the key plug 12 to be rotated in the direction of the arrow 100 in FIG. 10 until the edge 102 of the retaining wafer 40 abuts to the facing edge 104 bounding the guide slot 94. This latter position is shown in FIGS. 14–18.

With the plug 12 repositioned to the orientation shown in FIGS. 14–18, the retaining wafer 40 clears the circumferential edge 105 of the wall 98 and is allowed to retract to a position shown in FIGS. 19–23, whereupon the wafer 40 encounters an axially facing shoulder 106 defined on the housing/support 20. The axially facing shoulder 106 is disposed at an angle less than 90° relative to the key plug axis 14.

By then rotating the plug 12 back to the position shown in FIGS. 5–13, the wafer 40 aligns with a guide slot portion 110, which extends fully to the proximal end 112 of the receptacle 22 to allow removal of the key plug 12.

Assembly of the key plug 12 involves reversal of the disassembly steps just described.

The foregoing disclosure of specific embodiments is intended to be illustrative of the broad concepts comprehended by the invention.

We claim:

1. A lock assembly comprising:

a key plug having an axis;

a first housing defining a receptacle for the key plug;

said first housing guiding movement of the key plug in the receptacle around the key plug axis;

a latch assembly including a first movable latch element;

means cooperating between the first housing and the latch assembly for supporting the latch assembly in an operative position on the first housing wherein the first latch element is movable between first and second positions relative to the first housing;

a retaining element;

means mounting the retaining element to the key plug for movement relative to the key plug between first and second positions, said key plug being selectively movable into the key plug receptacle to an operative position and removable from the key plug receptacle with the retaining element in its first position;

means cooperating between the retaining element and the latch assembly for preventing withdrawal of the key plug from the first housing receptacle with the key plug in its operative position and the retaining element in its second position, the means cooperating between the retaining element and the latch assembly comprising a first surface on the latch assembly that is directly abuttable to the retaining element to prevent outward withdrawal of the key plug; and means cooperating between the retaining element and the first housing for preventing the key plug from being moved axially out of its operative position and fully separated from the first housing without rotation of the key plug relative to the first housing with the retaining element in its first position.

2. The lock assembly according to claim 1 wherein the retaining element comprises a first wafer and the means mounting the retaining element to the key plug mounts the first wafer for movement relative to the key plug transversely to the key plug axis between its first and second positions.

3. The lock assembly according to claim 1 in combination with a first support on which the lock assembly is mounted and a second support on which the first support is mounted for movement relative to the second support, wherein the latch element comprises means cooperating between the first and second supports for limiting movement of the first support relative to the second support.

4. The lock assembly according to claim 3 wherein the second support comprises a second housing, the first support comprises a paddle mounted to the second housing for movement between a normal position and a release position, said first housing being on the paddle, there is a latch mechanism on the second housing having a second latch element movable relative to the second housing between latched and unlatched positions, and there are means cooperating between the paddle and the latch mechanism for moving the second latch element between the latched and unlatched positions as an incident of the paddle moving between its normal and release positions.

5. The lock assembly according to claim 4 wherein there are means cooperating between the first latch element and second housing for a) preventing movement of the paddle from its normal position to its release position with the first latch element in one of its first mid second positions and b) permitting the paddle to move from its normal position to its release position with the first latch element in the other of its first and second positions.

6. The lock assembly according to claim 1 in combination with a frame defining an opening, wherein the lock assembly is mounted on a closure that is movable relative to the frame between a) an open state wherein the frame opening can be accessed and b) a closed state, there is a latch mechanism on the closure having a second latch element movable relative to the closure between c) a latched position wherein the second latch element maintains the closure in the closed state and d) an unlatched position, there being means cooperating between the second latch element and frame for maintaining the closure in its closed state relative to the frame.

7. The lock assembly according to claim 1 wherein there is a latch mechanism on the first housing with a second latch element movable between a latched position and an unlatched position, there is an actuator for the latch mechanism, there further being means for mounting the actuator for movement relative to the first housing between a normal position and a release position, said first latch element being movable between first and second positions, there being means cooperating between the actuator and latch mechanism for moving the second latch element from its latched position to its unlatched position as an incident of the actuator moving from the normal position to its release position, there further being means cooperating between the first latch element and actuator for a) preventing the actuator from moving from its normal position into its release position with the first latch element in one of its first and second positions and b) allowing the actuator to move from its normal position into its release position with the fist latch element in the other of its first and second positions.

8. The lock assembly according to claim 7 wherein the actuator comprises a pivotable paddle.

9. The lock assembly according to claim 1 wherein the first housing has a wall and the latch assembly includes a body and a holding element and the body and holding element captively embrace the first housing wall.

10. The lock assembly according to claim 1 wherein the latch assembly includes a body having a curved wall extending through less than 360° and the means cooperating between the retaining element and latch assembly includes an opening in the curved wall on the body into which the retaining element projects with the retaining element in its second position.

11. The lock assembly according to claim 10 wherein the curved wall on the body extends through approximately 180°.

12. The lock assembly according to claim 2 in combination with a removal key, the key plug has an axially extending keyway and there are means cooperating between the removal key and first wafer for moving the first wafer from its second position into its first position as an incident of the removal key being directed into the keyway in the key plug.

13. The lock assembly according to claim 12 wherein there are first means cooperating between the key plug and first housing for a) permitting movement of the key plug about the key plug axis with the first cooperating means in a first state and b) preventing movement of the key plug about the key plug axis with the first cooperating means in a second state, there further being a change key and means cooperating between the change key and the first cooperating means for changing the first cooperating means from its second state into its first state as an incident of the change key being directed into the keyway in the key plug, said first wafer remaining in its second position with the change key in the keyway in the key plug.

14. The lock assembly according to claim 13 wherein the first cooperating means includes at least a second wafer mounted to the key plug for movement relative to the key plug transversely to the key plug axis.

15. The lock assembly according to claim 13 wherein there are means cooperating between the removal key and first cooperating means for changing the first cooperating means from its second state into its first state as an incident of the removal key being directed into the keyway in the key plug.

16. The lock assembly according to claim 2 wherein the means cooperating between the first housing and the first wafer for preventing the key plug from being moved axially out of its operative position comprises an axially facing shoulder on the first housing.

17. The lock assembly according to claim 16 wherein the latch assembly includes a body having a curved wall extending through less than 360° and the means cooperating between the retaining element and latch assembly includes an opening in the crowed wall on the body into which the first wafer projects with the first wafer in its second position, the first wafer axially overlaps the axially facing shoulder on the key plug housing with the first wafer in its first position, said first wafer not extending into the curved wall on the body with the first wafer in its first position.

18. The lock assembly according to claim 14 wherein the first cooperating means includes an axial guide slot that receives the at least second wafer with the first cooperating means in its second state.

19. The lock assembly according to claim 16 wherein the axially facing shoulder extends less than 360° around the key plug axis.

20. A lock assembly comprising:

key plug having an axis;

a first housing defining a receptacle for the key plug;

said first housing guiding movement of the key plug in the receptacle around the key plug axis;

a latch assembly including a first movable latch element;

means cooperating between the latch assembly and at least one of the key plug and the first housing for supporting the latch assembly in an operative position wherein the first latch element is movable between the first and second positions relative to the first housing;

a retaining element;

means mounting the retaining element to the key plug for movement relative to the key plug between first and second positions, said key plug being selectively movable into the key plug receptacle to an operative position and removable from the key plug receptacle with the retaining element in its first position; and second means cooperating between the retaining element and the first housing for preventing the key plug from being moved axially outs of its operative position and fully separated from the first housing without rotation of the key plug relative to the first housing with the retaining element in its first position, the second means comprising a surface extending at least partially around the key plug axis, the surface disposed at an angle less than 90° relative to the key plug axis, the surface and the retaining element being abuttable to each other to prevent the key plug from being moved axially out of its operative position and fully separated from the first housing without rotation of the key plug relative to the first housing with the retaining element in its first position.

21. The lock assembly according to claim 20 wherein the second means comprises an axially facing shoulder extending less than 360° around the axis of the first housing.

22. The lock assembly according to claim 20 wherein the retaining element comprises a first wafer and the means mounting the retaining element to the key plug mounts the first wafer for movement relative to the key plug transversely to the key plug axis between its first and second positions.

23. The lock assembly according to claim 20 wherein there are first means cooperating between the key plug and first housing for a) permitting movement of the key plug about the key plug axis with the first cooperating means in a first state and b) preventing movement of the key plug about the key plug about the key plug axis with the first cooperating means in a second state, there further being a change key and means cooperating between the change key and the first cooperating means for changing the first cooperating means from its second state into its first state as an incident of the change key being directed into the keyway in the key plug, said first wafer remaining in its second position with the change key in the keyway in the key plug.

24. The lock assembly according to claim 23 in combination with a removal key, there are means cooperating between the removal key and the retaining element for moving the retaining element from its second position into its first position as an incident of the removal key being directed into the keyway in the key plug , there further being means cooperating between the removal and first cooperating means for changing the first cooperating means for its second state into its first state as an incident of the removal key being directed into the keyway in the key plug.

25. The lock assembly according to claim 1, the means cooperating between the retaining element and the latch assembly comprising a second surface on the retaining element, the first and second surfaces being directly abuttable to prevent outward withdrawal of the key plug axis.

26. The lock assembly according to claim 25, the first and second surfaces being orthogonal to the key plug axis and extending at least partially around the key plug axis.

27. The lock assembly according to claim 1, the first surface at least in part defining an aperture in the latch assembly, the retaining element in its second position disposed at least partially through the aperture.

* * * * *